US010760434B2

(12) United States Patent
Kolvick et al.

(10) Patent No.: US 10,760,434 B2
(45) Date of Patent: Sep. 1, 2020

(54) TRANSFER OF TURBINE BLADES TO ROTOR WHEEL

(71) Applicant: General Electric Company, Schenectady, NY (US)

(72) Inventors: Sandra Beverly Kolvick, Simpsonville, SC (US); Kevin Leon Bruce, Greer, SC (US); Antoine Mastroianni, Bourogne (FR)

(73) Assignee: General Electric Company, Schenectady, NY (US)

( * ) Notice: Subject to any disclaimer, the term of this patent is extended or adjusted under 35 U.S.C. 154(b) by 113 days.

(21) Appl. No.: 15/802,859

(22) Filed: Nov. 3, 2017

(65) Prior Publication Data

US 2018/0163549 A1 Jun. 14, 2018

(30) Foreign Application Priority Data

Dec. 13, 2016 (EP) ..... 16290231

(51) Int. Cl.
*F01D 25/28* (2006.01)
*F01D 5/30* (2006.01)

(52) U.S. Cl.
CPC ..... *F01D 5/3007* (2013.01); *F01D 5/30* (2013.01); *F01D 5/3015* (2013.01); *F01D 25/28* (2013.01);
(Continued)

(58) Field of Classification Search
CPC ..... F01D 5/3007; F01D 5/30; F01D 25/28; F01D 5/3015; F01D 25/285; F05D 2230/64
See application file for complete search history.

(56) References Cited

U.S. PATENT DOCUMENTS 5,183,244 A 2/1993 Ortolano et al.
7,353,588 B2 4/2008 Crain et al.
(Continued)

FOREIGN PATENT DOCUMENTS

EP 2 354 456 A2 8/2011
EP 3 043 029 A1 7/2016
EP 3 078 810 A1 10/2016

OTHER PUBLICATIONS

Extended European Search Report and Opinion issued in connection with corresponding EP Application No. 16290231.6 dated Apr. 3, 2017.

*Primary Examiner* — Lawrence Averick
(74) *Attorney, Agent, or Firm* — Armstrong Teasdale LLP

(57) ABSTRACT

A fixture for transferring turbine blades may include: a first body having an arcuate radially inward surface shaped to contact a rotor of a turbomachine, and a radially outward surface including a plurality of dovetail slots therein shaped to engage the dovetails of the plurality of turbine blades; and a first alignment aperture extending axially through the first body relative to a centerline axis, and positioned for alignment with a portion of the rotor wheel such that the plurality of dovetail slots of the first body are substantially axially aligned with the plurality of dovetail slots of the rotor wheel for at least partial transfer of the turbine blade thereto from the fixture, wherein the dovetails of the plurality of turbine blades are slidably removable from the plurality of dovetail slots of the first body for guided insertion into the plurality of dovetail slots of the rotor wheel.

17 Claims, 8 Drawing Sheets

(52) U.S. Cl.
CPC ..... *F01D 25/285* (2013.01); *F05D 2230/64* (2013.01)

(56) References Cited

U.S. PATENT DOCUMENTS

| | | | | |
|---|---|---|---|---|
| 8,046,886 | B2 | 11/2011 | DeMania et al. | |
| 2014/0304989 | A1 | 10/2014 | Lecuyer et al. | |
| 2015/0128417 | A1 | 5/2015 | Laborde | |
| 2015/0218948 | A1 | 8/2015 | Bird | |
| 2016/0201556 | A1* | 7/2016 | Kolvick ..... | F01D 5/3007 29/888.012 |

* cited by examiner

TRANSFER OF TURBINE BLADES TO ROTOR WHEEL

BACKGROUND

The present disclosure relates generally to turbomachines, and more particularly, to fixtures and methods for transferring turbine blades to a rotor wheel by using components mounted proximally to, and substantially aligned with, the rotor wheel.

Rotors for turbomachines such as turbines are often machined from large forgings. Rotor wheels cut from the forgings are typically slotted to accept the roots of turbine blades for mounting. As the demand for greater turbine output and more efficient turbine performance continues to increase, larger and more articulated turbine blades are being installed in turbomachines. Latter stage turbine blades are one example in a turbine where blades are exposed to a wide range of flows, loads and strong dynamic forces. Consequently, optimizing the performance of these latter stage turbine blades in order to reduce aerodynamic losses and to improve the thermodynamic performance of the turbine can be a technical challenge.

Dynamic properties that affect the design of these latter stage turbine blades include the active length of the blades, the pitch diameter of the blades and the high operating speed of the blades in both supersonic and subsonic flow regions. Damping and blade fatigue are other properties that have a role in the mechanical design of the blades and their profiles. These mechanical and dynamic response properties of the blades, as well as others, such as aero-thermodynamic properties or material selection, all influence the relationship between performance and profile of the turbine blades. Consequently, the profile of the latter stage turbine blades often includes a complex blade geometry for improving performance while minimizing losses over a wide range of operating conditions.

The application of complex blade geometries to latter stage turbine blades presents certain challenges in assembling these blades on a rotor wheel. For example, adjacent turbine blades on a rotor wheel are typically connected together by cover bands or shroud bands positioned around the periphery of the wheel to confine a working fluid within a well-defined path and to increase the rigidity of the blades. These interlocking shrouds may impede the assembly of blades on the rotor wheel. In addition, inner platforms of these blades may include tied-in edges, which also can impede their assembly on the rotor wheel. In some cases, it may be desirable to install multiple turbine blades in a rotor wheel simultaneously. Due to the size and design of each blade, doing so manually or with conventional tools may be impractical.

SUMMARY

A first aspect of the present disclosure provides a fixture for transferring a plurality of turbine blades, each having a dovetail, into a rotor wheel of a turbomachine, the rotor wheel including a plurality of circumferentially spaced dovetail slots, the fixture including: a first body having an arcuate radially inward surface shaped to contact a rotor of the turbomachine, and a radially outward surface including a plurality of dovetail slots therein shaped to engage the dovetails of the plurality of turbine blades; and a first alignment aperture extending axially through the first body relative to a centerline axis of the turbomachine, and positioned for alignment with a portion of the rotor wheel such that the plurality of dovetail slots of the first body are substantially axially aligned with the plurality of dovetail slots of the rotor wheel for at least partial transfer of the turbine blade thereto from the fixture, wherein the dovetails of the plurality of turbine blades are slidably removable from the plurality of dovetail slots of the first body for guided insertion into the plurality of dovetail slots of the rotor wheel.

A second aspect of the present disclosure provides a fixture for transferring a plurality of turbine blades, each having a dovetail, into a rotor wheel of a turbomachine having an open rotor therein, the rotor wheel including a plurality of circumferentially spaced dovetail slots, the fixture including: a first body having an arcuate radially inward surface shaped to contact a platform engaging an axial sidewall of the rotor wheel, and a radially outward surface including a plurality of dovetail slots therein shaped to engage the dovetails of the plurality of turbine blades; and a first alignment aperture extending axially through the first body relative to a centerline axis of the turbomachine, and positioned for alignment with a portion of the rotor wheel such that the plurality of dovetail slots of the first body are substantially axially aligned with the plurality of dovetail slots of the rotor wheel for at least partial transfer of the turbine blade thereto from the fixture, wherein the dovetails of the plurality of turbine blades are slidably removable from the plurality of dovetail slots of the first body for guided insertion into the plurality of dovetail slots of the rotor wheel.

A third aspect of the present disclosure provides a method for transferring a plurality of turbine blades having adjacent dovetails into a rotor wheel of a turbomachine, the rotor wheel having a plurality of circumferentially spaced dovetail slots, the method comprising: engaging a radially inward surface of a fixture with a radially exterior surface of the turbomachine axially proximal to the rotor wheel relative to a centerline axis of the turbomachine, such that a plurality of dovetail slots of the fixture are substantially axially aligned with the plurality of dovetail slots of the rotor wheel; loading a plurality of turbine blades into the plurality of dovetail slots of the fixture, wherein each of the plurality of dovetail slots of the fixture at least partially engage a respective dovetail one of the plurality of turbine blades after the loading; and transferring, in a substantially axial direction, the plurality of turbine blades from plurality of dovetail slots of the fixture to the plurality of dovetail slots of the rotor wheel.

DETAILED DESCRIPTION

Spatially relative terms, such as "inner," "outer," "beneath," "below," "lower," "above," "upper," "inlet," "outlet," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
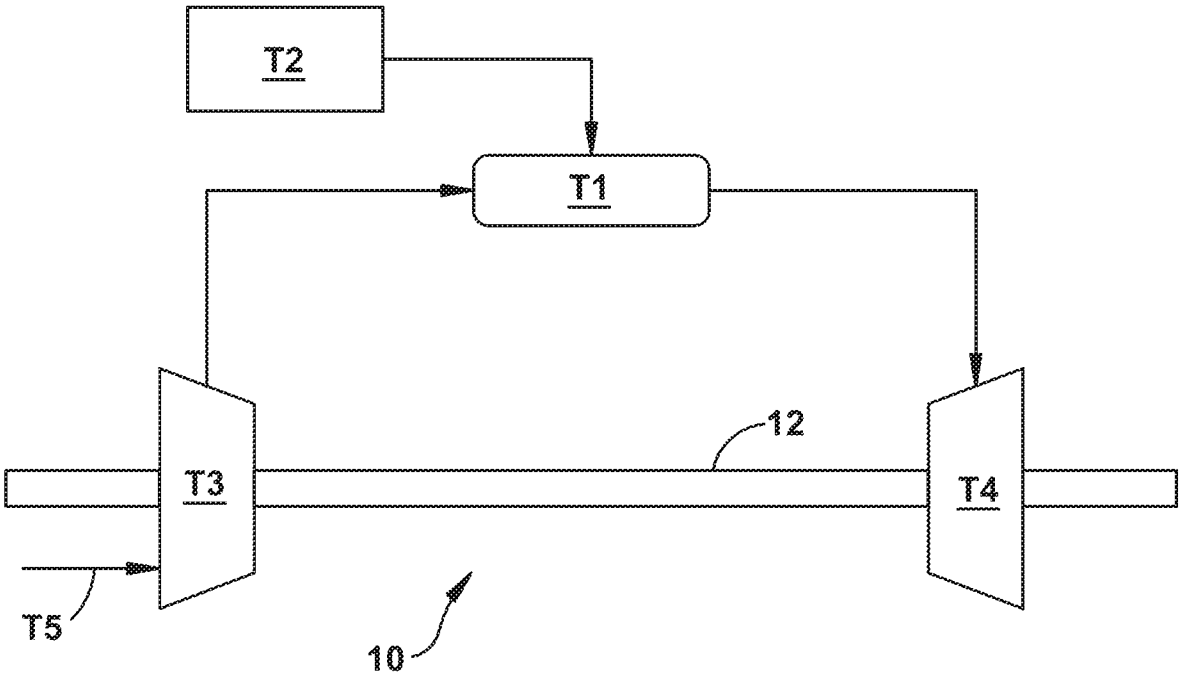
FIG. 1 (Prior Art)
FIG. 1 is a schematic view of a conventional power generation system.

FIG. 1 shows a schematic view of a conventional turbomachine 10. A gas turbine is a type of turbomachine 10 in which compressed air is reacted with a fuel source to generate a stream of hot air. The hot air enters a turbine section and flows against several turbine blades to impart work against a rotatable shaft. The shaft can rotate in response to the stream of hot air, thereby creating mechanical energy for powering one or more loads (e.g., compressors and/or generators) coupled to the shaft. Embodiments of the present disclosure include a fixture for transferring rotor-mounted turbine blades into machines such as turbomachine 10, e.g., gas turbines, steam turbines, and/or other turbine assemblies. Fixtures according to the present disclosure can be operable to transfer turbine blades to turbomachine 10 where conventional devices may not be usable or practical. Embodiments of the present disclosure may also be capable of transferring turbine blades which cannot be installed or removed solely by the application of mechanical force in one direction. To better illustrate features of the present disclosure during operation, example characteristics of turbomachine 10 are discussed. Combustors T1, connected to fuel nozzles T2, are typically located between compressor T3 and turbine T4 sections of turbomachine 10. Fuel nozzles T2 can introduce fuel into combustor T1 which reacts with compressed air yielded from compressor T3. Air T5 flows sequentially through compressor T3, combustor T1, and lastly through turbine T4. Work imparted to a rotor 12 through turbine T4 can, in part, drive compressor T3. Other forms of turbomachinery besides gas turbines (e.g., gas turbine assembly T) may feature a similar arrangement of components.

Figure 2:
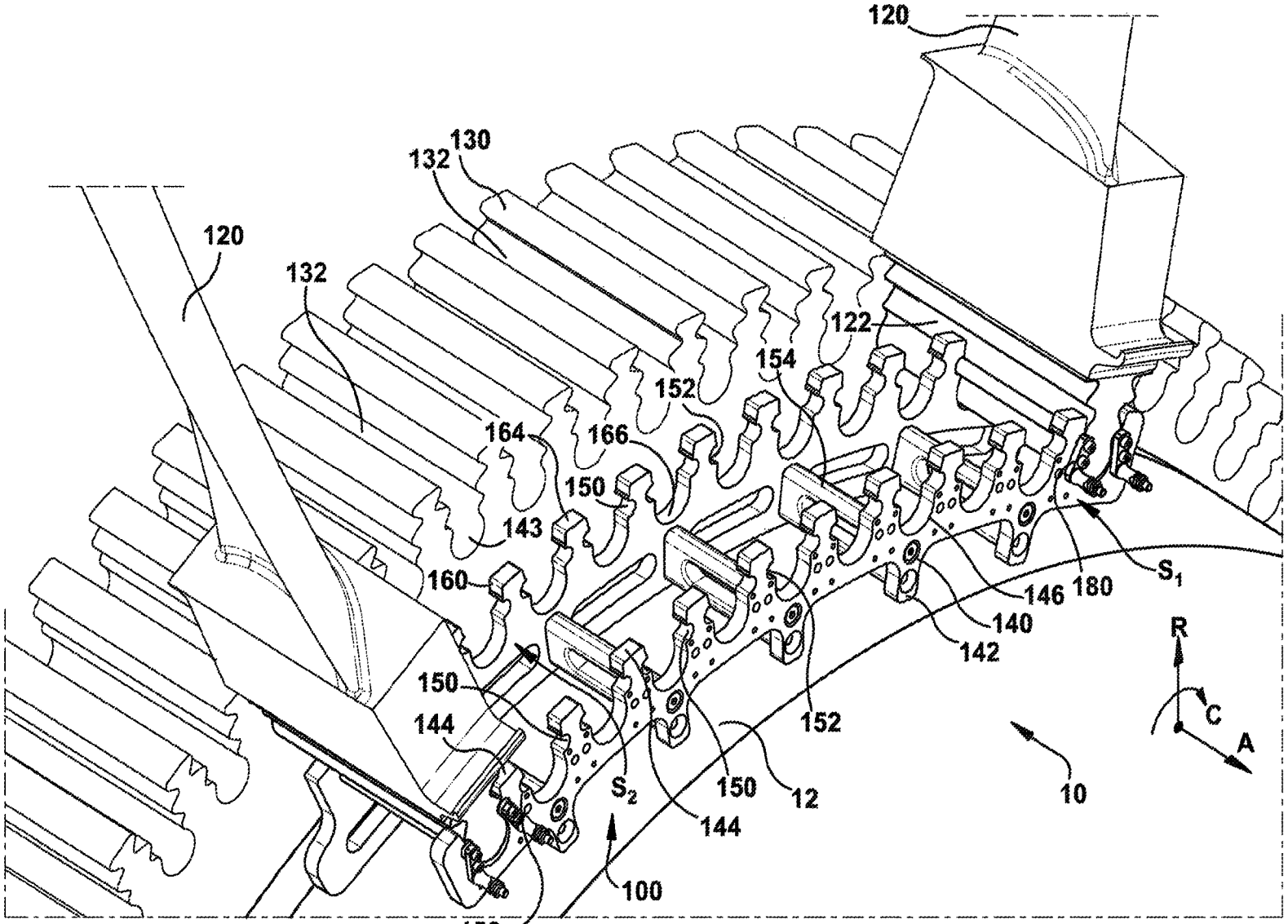
FIG. 2 is a perspective view of a fixture and rotor wheel according to embodiments of the disclosure.

Referring to the drawings, FIG. 2 illustrates a fixture 100 adapted for transferring a plurality of turbine blades 120, each having a respective dovetail protrusion 122, into a rotor wheel 130 of turbomachine 10 (FIG. 1). In operation, fixture 100 can engage rotor 12 at a predetermined location where turbine blades can be mounted and/or engaged. Each turbine blade 120 can initially be mechanically coupled to fixture 100. Fixture 100 can be substantially axially aligned (i.e., aligned substantially along the direction of the rotor) with similarly sized and profiled dovetail slots 132 of rotor wheel 130 axially proximal to fixture 100. Turbine blades 120 can be at least partially axially transferred from fixture 100 to adjacent rotor wheels 130 during operation. As used herein, the term "transfer" or "axial transfer" refers to the process of moving (e.g., by sliding motion) turbine blade(s) 120 from one position to another, such as from fixture 100 into rotor wheel 130. Thus, embodiments of fixture 100 and other fixtures discussed herein can allow turbine blades 120 to be installed within turbomachine 10 without additional and/or intervening structures or processes. Embodiments of the present disclosure can therefore include methods of installing turbine blades 120 by using embodiments of fixture 100.

Fixture 100 can be operable to transfer turbine blades 120 into a corresponding set of circumferentially spaced dovetail slots 132 of rotor wheel 130. Fixture 100 may be advantageous for transferring multiple turbine blades 120 to rotor wheel 130 simultaneously, e.g., where structural features of blades 120 impede or prevent successive transfer of each blade 120, and/or where simultaneously transferring blades 120 offers a significant reduction in time and/or cost. Fixture 100 can include a first body 140 including an arcuate radially inward surface 142 shaped to contact rotor 12 of turbomachine 10, e.g., at a position axially adjacent or otherwise proximal to rotor wheel 130. First body 140 and/or other components of fixture 100 can be composed of any currently-known or later-developed material adapted for supporting the composition of turbine blades 120, and as general examples can include one or more polymerous materials (e.g., a thermoelastic polymer such as polyoxymethylene, acrylonitrile butadiene styrene) and/or metal compounds (e.g., steel, iron, aluminum, etc.). In some embodiments, fixture 100 can be positioned directly axially adjacent to rotor wheel 132 such that fixture 100 engages an axial sidewall 143 of rotor wheel 132, e.g., through direct contact. Fixture 100 can also include a radially outward surface 144 with multiple dovetail slots 146. Each dovetail slot 146 of fixture 100 can be shaped to engage a corresponding dovetail protrusion 122 of one turbine blade 120. Thus, fixture 100 can engage multiple turbine blades 120 therein through dovetail slots 146. First body 140 can include one or more support members 148 extending, e.g., radially outward such that the radial displacement between dovetail slots 146 and a centerline axis of turbomachine 10 is substantially equal to that between dovetail slots 132 and the same centerline axis. It is understood that the number of support members 148 in fixture 100 can vary, for example, based on the size of fixture 100 and/or rotor wheel 130.

Dovetail slots 146 of fixture 100 can be shaped for insertion of turbine blades 120 therein before turbine blades are transferred to rotor wheel 130. In some cases, axial mismatch between dovetail slots 146 may impede or prevent transfer of turbine blades 120 to rotor wheel 130. Axial mismatch refers to a situation where dovetail slots 146 extend axially in parallel relative to dovetail slots 132 of rotor wheel 130 without being substantially aligned with dovetail slots 132 while positioned in fixture 100. To avoid problems associated with mismatch between dovetail slots 132 of rotor wheel 130 and dovetail slots 146 of fixture 100, fixture 100 can include a first alignment aperture 150 extending axially through first body 140 relative to centerline axis A of turbomachine 10. First alignment aperture 150 can conceivably be positioned in any desired region of fixture 100 such that dovetail slots 146 of first body 140 are substantially axially aligned with corresponding dovetail slots 132 of rotor wheel 130. In further embodiments, first body 140 can also include a second alignment aperture 152 positioned adjacent to dovetail slot 146 opposite from first alignment aperture 150. First and second alignment apertures 150, 152 can define an axial boundary between dovetail slots 146 substantially coincident with portions of rotor wheel 130 which circumferentially separate adjacent dovetail slots 132 therein. Although first alignment aperture 150 may be embodied as a hole, portal, passage, etc., it is understood that first alignment aperture 150 may alternatively embodied as, e.g., a scallop or partially enclosed passage (e.g., quarter circle, half circle, etc.) shaped to receive and at least partially engage an alignment pin 180, as discussed elsewhere herein. Other apertures discussed herein can similarly be embodied in such alternative forms.

When fixture 100 is positioned on rotor 12, alignment apertures 150, 152 can be positioned circumferentially adjacent to successive dovetail slots 146 on first body 140. Alignment apertures 150, 152 being positioned circumferentially between dovetail slots 146 on fixture 100 can allow a user to axially align alignment aperture(s) with portions of rotor wheel 130 positioned circumferentially between dovetail slots 132. Regardless of where alignment apertures 150, 152 are positioned relative to rotor wheel 130, a user may align fixture 100 with corresponding portions of rotor wheel 130 by way of visual inspection and/or other instruments used with alignment apertures 150, 152 described elsewhere herein. Alignment apertures 150, 152 can allow a user to visually inspect whether turbine blades 120 are slidably removable from dovetail slots 146 of first body 140 for guided insertion into dovetail slots 132 of rotor wheel at a predetermined position. In addition, alignment apertures 150, 152 can allow a user to determine whether multiple dovetail slots 146 of fixture 100 are aligned with multiple dovetail slots 132 of rotor wheel 130. Axial alignment between multiple dovetail slots 132, 146 of fixture 100 and rotor wheel 130 can allow multiple turbine blades 120 to be transferred to rotor wheel 130 together, e.g., as part of a single transferring process. Methods for using fixture 100 to transfer turbine blades 120 to rotor wheel 130 are shown in other FIGS. and described in detail elsewhere herein.

Figure 3:
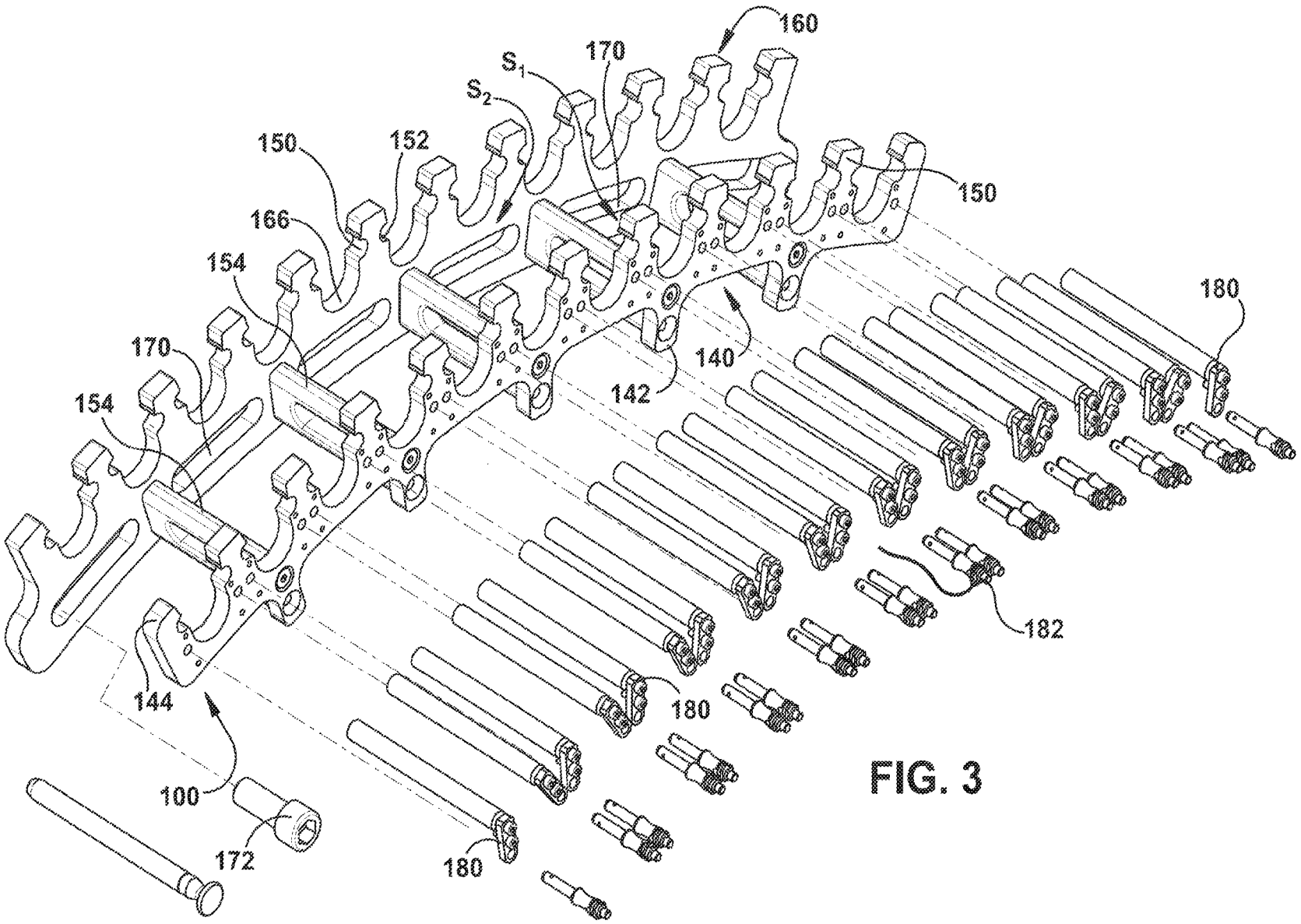
FIG. 3 is a perspective view of a fixture according to embodiments of the disclosure.

Referring to FIGS. 2 and 3 together, fixture 100 may include additional components for increasing mechanical stability, alignment between dovetail slots 132, 146, and/or other operational characteristics of fixture 100. For example, fixture 100 can include an axial member 154 coupled to an axial sidewall Si of first body 140. Axial member 154 may include, e.g., a rigid beam, pole, bolt, etc., with the same material composition as first body 140 or may include a different material composition. As shown in the accompanying FIGS., multiple axial members 154 may each be coupled to first body 140 at respective locations, and can extend substantially in axial direction A relative to turbomachine 10. One or more axial members 154 may also be coupled to an axial sidewall $S_2$ of a second body 160 at an opposite end relative to first body 140. Second body 160 may be structurally similar or identical to first body 140, and thus may include the same or similar features therein. For example, second body 160 may include an arcuate radially inward surface 142 shaped to circumferentially engage rotor 12. Second body 160 may also include a radially outer surface 164 with multiple dovetail slots 166. Each dovetail slot 166 of second body 160 can be shaped to engage a corresponding dovetail protrusion 122 of one turbine blade 120. Thus, each body 140, 160 of fixture 100 can engage multiple turbine blades 120 therein through dovetail slots 146, 166. Axial members 154 of fixture 100 can connect and axially align first and second bodies 140, 160. Axial members 154 can cause each dovetail slot 146 of first body 140 to be substantially axially aligned with a respective dovetail slot 166 of second body 160 and a respective dovetail slot 132 of rotor wheel 130. Second body 160 may also include first and second alignment apertures 150, 152 similar to those of first body 140 and/or arranged in the same manner. For example, first and second alignment apertures 150, 152 may be positioned adjacent to opposing circumferential sidewalls of one or more dovetail slots 166 of second body 160.

Fixture 100 may also include additional components for maintaining first and second bodies 140, 160 in a fixed position before turbine blades 120 are installed. For example, first or second body 140, 160 can include slots 170 shaped to receive a coupler 172 therein. Coupler 172 may be provided in the form of, e.g., a bolt, a rod, a threaded member, and/or any other mechanical instrument shaped to extend through slot(s) 170 to engage a portion of rotor wheel 130. Coupler 172 may engage a complementary surface of rotor wheel 130 when extending through slot 170, e.g., as shown, or may extend into complementary features of rotor wheel 130 as described elsewhere herein. In any event, coupler(s) 172 can be inserted into slot(s) 170 of fixture 100 after fixture 100 is mounted on rotor wheel 12 to secure fixture 100 in a predetermined position.

Fixture 100 may include a group of alignment pins 180 coupled to fixture 100 (e.g., at first body 140) through a tether 182 to align fixture 100 with slots 132. Each alignment pin 180 can include one or more inflexible materials shaped to extend linearly through first and/or second alignment apertures 150, 152 of fixture 100 and along axial axis A. Before positioning turbine blades 120 in dovetail slots 146, 166 or transferring turbine blades 120 therefrom, a user may insert alignment pins 180 through alignment apertures 150, 152 to define an axial path along which each turbine blade 120 may travel when being transferred to dovetail slots 132 of rotor wheel 130. Alignment pins 180 may obstruct turbine blades 120 from entering axially misaligned dovetail slots 132 and/or contacting other portions of rotor wheel 130. Tethers 182 may be composed of a flexible material (e.g., plastics and/or fibrous materials which may be reinforced with metals therein) to physically couple each alignment pin 180 to fixture 100. Tethers 182 can prevent alignment pins 180 from being dislodged or separated from fixture 100 in the event of a mechanical shock, and/or can prevent alignment pins 180 from being misplaced or accidentally dropped, inserted, etc., into sensitive portions of turbomachine 10. Alignment pins 180 are shown by example to be disconnected from tethers 182 in FIG. 3 for the sake of demonstration. Each alignment pin 180 can be mechanically connected to a respective tether 182 before fixture 100 is positioned on rotor 12.

Alignment pins 180 may be embodied as, e.g., quick release pins configured to be selectively mechanically secured to fixture 100 at a desired position. For instance, alignment pins 180 may be configured to lock into place against fixture 100 when fully inserted through alignment aperture(s) 150, 152 to engage rotor wheel 130. An operator of fixture 100 may then selectively disengage alignment pin(s) 180 from fixture 100 to remove alignment pin(s) from alignment apertures 150, 152. In alternative embodiments, alignment pins 180 may include other fastening elements (e.g., simple pins, locks, clamps, etc.) for maintaining alignment pins 180 in a selected position relative to fixture 100 and/or rotor wheel 130. Such fastening elements may lack quick release components and/or functionality, and/or may be structured to accommodate multiple gas turbine frame sizes. In still further embodiments, alignment pins 180 may include multiple axially-aligned and/or axially connected segments, members, etc., to accommodate gas turbine frames of varying size. Alignment pin(s) 180 may thus include two or more individual members mechanically connected and/or matingly engaged to each other before being inserted in to alignment aperture(s) 150, 152 as a single alignment pin 180.

Figure 4:
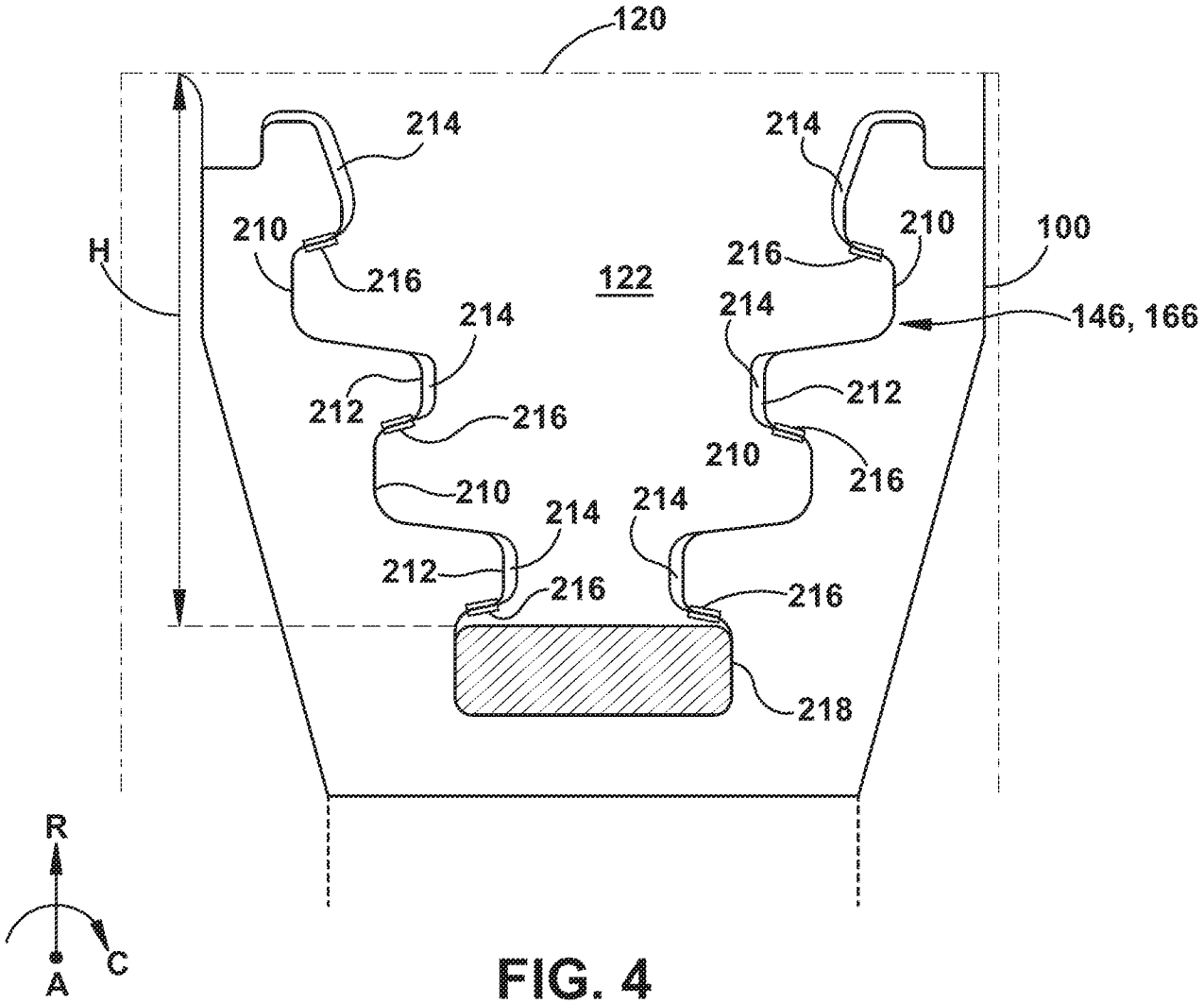
FIG. 4 is a partial cross-sectional view of a turbine blade dovetail and a dovetail slot in a fixture according to embodiments of the disclosure.

In FIG. 4, geometrical features of the engagement between a turbine blade 120 and dovetail slot(s) 146, 166 of fixture 100 are shown. It is understood that the various features shown in FIG. 4 may be included in dovetail slot(s) 146 of first body 140 (FIGS. 2-3) or dovetail slot 166 of second body 160 (FIGS. 2-3) in any embodiment. FIG. 4 includes a cross-sectional view of dovetail slot 146, 166 engaging a turbine blade 120 by receiving a dovetail protrusion 122 within dovetail slot 146, 166. Dovetail slot(s) 146, 166 of fixture 100 can include a profile with a substantially undulating or "fir tree" shape with multiple necks 210 alternating with hooks 212 (e.g., in the form of protrusions or similar surfaces) for engaging similarly contoured surfaces of turbine blade 120, with or without direct contact between the two components throughout dovetail slot(s) 146, 166. Each neck 210 can include a substantially planar contact surface for engaging a dovetail of turbine blade 120. Although dovetail slot 146, 166 is shown by example as substantially complementing a cross-section of turbine blade 120, it is understood that dovetail slot 146, 166 can be of any desired shape or geometry, e.g., a substantially v-shaped slot, one or more triangular wedges, a rectangular or semi-circular slot, a slot formed in the shape of a complex geometry, etc.

Several hooks 212 can include non-contacting portions (e.g., surfaces) separated from the dovetail of turbine blade 120 when turbine blade 120 engages dovetail slot 146, 166 of fixture 100. These non-contacting portions can define a group of pockets 214 which separate portions of fixture 100 from turbine blade 120. Pockets 214 can protect portions of dovetail slot 146, 166 of fixture 100 from damage caused by, e.g., manufacturing variances between turbine blades 120, vibratory motion or damage, external shocks and events, frictional contact between the two components, etc. Pockets 214 can be formed, e.g., by removing portions of material from fixture 100 and/or otherwise manufacturing or modifying fixture 100 to define pockets 214. Among other things, pockets 214 can prevent the structure of fixture 100 from contacting turbine blade 120 at sensitive locations. In operation, fixture 100 and turbine blade 120 can mechanically engage each other at a group of contacting surfaces 216 distributed throughout dovetail slot 146, 166 and turbine blade 120. Pockets 214 can also be formed by manufacturing, modifying, and/or otherwise machining turbine blade 120 to create separation between turbine blade 120 and dovetail slot 146, 166.

Dovetail protrusion 122 of turbine blade 120 may include a height dimension H of lesser magnitude than a corresponding height dimension of dovetail slot 146, 166. These differing heights can create a spacing differential between the two components and define a window space 218. Although one window space 218 is shown by example in FIG. 4, it is understood that multiple window spaces 218 can be defined between fixture 100 and turbine blade 120 in embodiments of the present disclosure. It is also understood that pockets 214 can also function as an at least partial window for providing view between fixture 100 and turbine blade 120 where applicable. Window space 218 can be present between dovetail slot 146, 166 and dovetail protrusion 122 when dovetail protrusion 122 is installed within fixture 100. Window space 218 can provide an axial view of an aligned dovetail slot of a rotor wheel (not shown) when dovetail protrusion 122 is positioned and/or secured within dovetail slot 146, 166.

Figure 5:
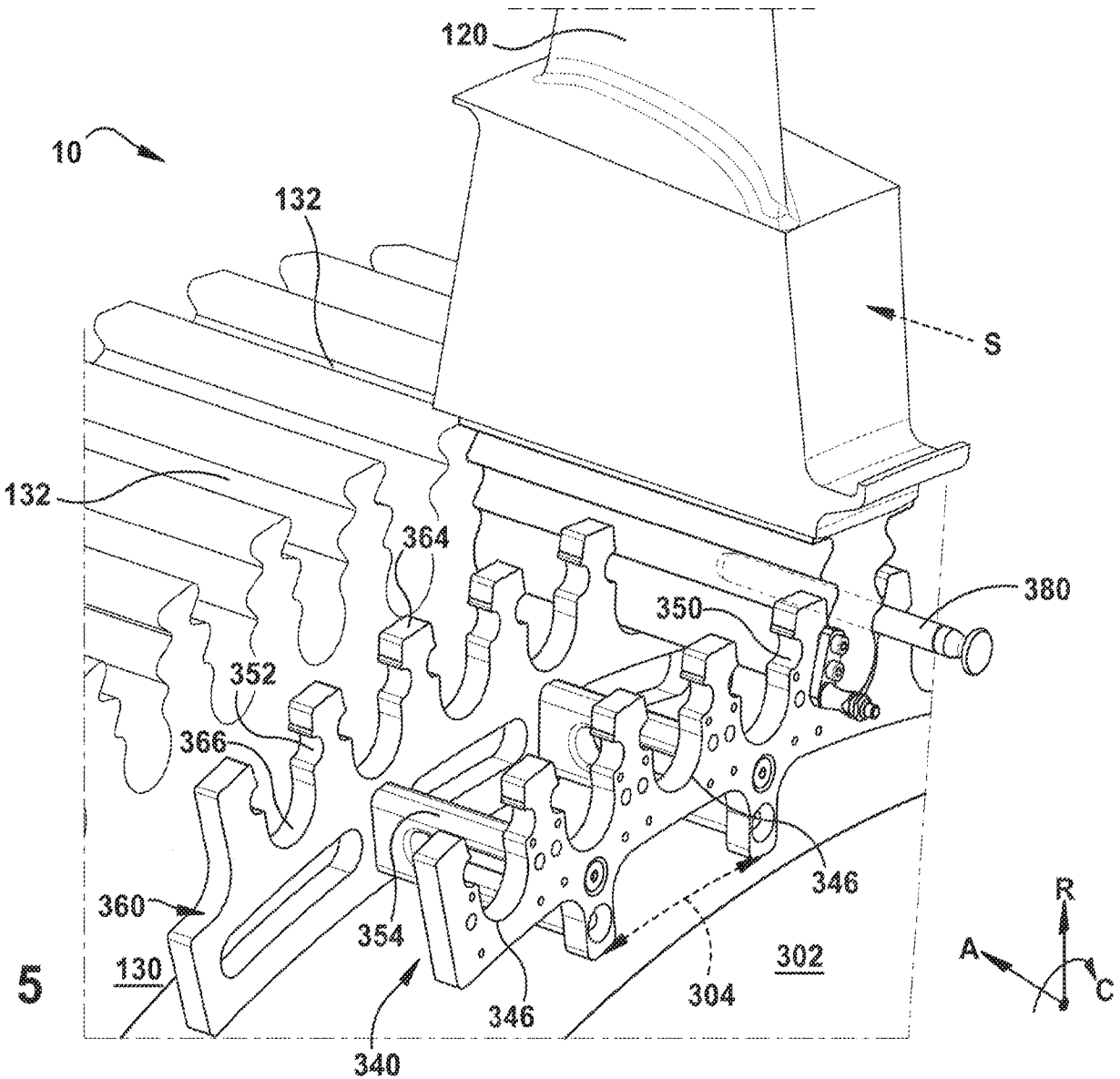
FIG. 5 is a partial perspective view of a fixture on a platform for an open rotor according to embodiments of the disclosure.
Figure 6:
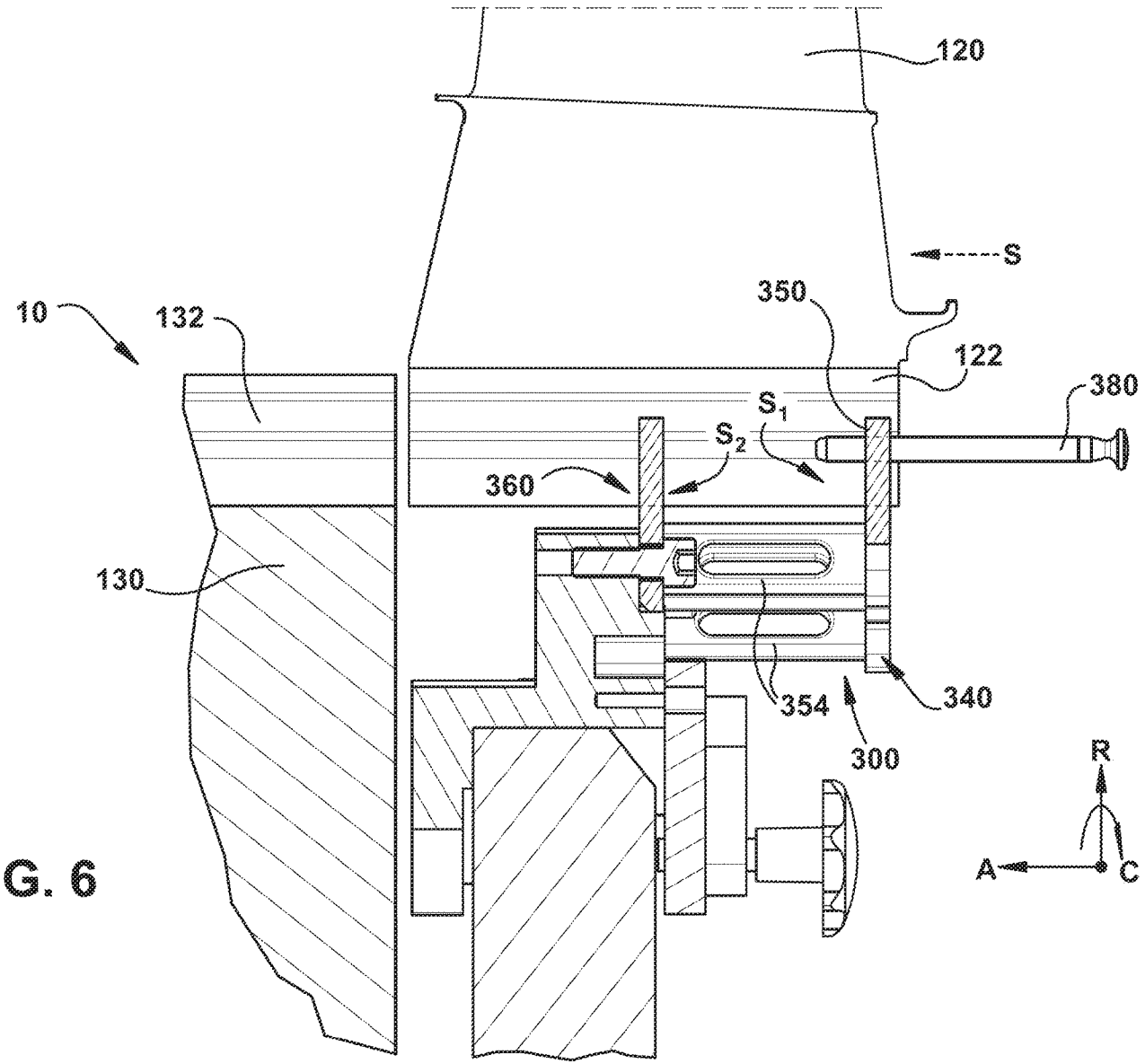
FIG. 6 is a side view of a fixture on a platform for an open rotor according to embodiments of the disclosure.

Referring to FIGS. 5 and 6 together, embodiments of the present disclosure can allow a user to transfer turbine blades 120 to rotor wheel 130 even when portions of rotor 12 (FIGS. 1-3) are not present. Rotor 12 of turbomachine 10 may be partially disassembled before turbine blades 120 are ready to be installed or removed within rotor wheel 130. In this situation, an operator may refer to turbomachine 10 as having an open rotor (e.g., vacant rotor space) therein. Other elements of turbomachine 10, e.g., rotor wheel 130 and dovetail slots 132, may be unchanged. A fixture 300 can enable transfer of turbine blades 120 without engaging rotor 12 of turbomachine 10, as discussed herein. For example, a platform 302 may be axially coupled to and/or mounted on a portion of rotor wheel 130, e.g., an axial sidewall of rotor wheel 130. Platform 302 may extend axially outward from rotor wheel 130 in a manner similar to that of rotor 12 in other embodiments. Platform 302 may include an arcuate profile 304 for receiving complimentary portions of fixture 300. In an example, fixture 300 may include a first body 340 with an arcuate radially inward surface 342 shaped to contact arcuate profile 304 of platform 302. First body 340 may also include a radially outward surface 344 with multiple dovetail slots 346 therein. Each dovetail slot 346 in fixture 300 can be shaped to receive a portion of turbine blade 120 therein, e.g., dovetail protrusion 122 of turbine blade 120. When turbine blades 120 are positioned within dovetail slots 346 of fixture 300, turbine blades 120 can be slidably removable therefrom for guided insertion into dovetail slots 132 of rotor wheel 130.

As described elsewhere relative to alternative embodiments, first body 340 of fixture 300 can include first and/or second alignment apertures 350, 352 extending axially therethrough. As noted herein, axial mismatch between dovetail slots 132, 346 may impede or prevent transfer of turbine blades 120 to rotor wheel 130. To avoid problems associated with mismatch between dovetail slots 132 of rotor wheel 130 and dovetail slots 346 of fixture 300, fixture 300 first and second alignment apertures 350, 352 can extend axially through first body 340 relative to centerline axis A of turbomachine 10. Alignment aperture 350, 352 can conceivably be positioned in any desired region of fixture 300 such that dovetail slots 346 of first body 340 are substantially axially aligned with corresponding dovetail slots 132 of rotor wheel 130. In some cases, second alignment aperture 352 may be positioned adjacent to dovetail slot 346 on an opposing side of dovetail slot 346 relative to first alignment aperture 350. First and second alignment apertures 350, 352 can define an axial boundary between dovetail slots 346 substantially coincident with portions of rotor wheel 130 which circumferentially separate adjacent dovetail slots 132 therein.

Fixture 300 may also include components for providing increased mechanical stability on platform 302. Fixture 100 can include an axial member 354 coupled to an axial sidewall $S_1$ of first body 340. Axial member 354 may include, e.g., one or more of the example components and/or material compositions described herein relative to axial member 154 (FIGS. 2-3). As shown in the accompanying FIGS., multiple axial members 354 may each be coupled to first body 340 at respective locations, and can extend substantially in axial direction A relative to turbomachine 10. One or more axial members 354 may also be coupled to an axial sidewall $S_2$ of a second body 360 at an opposite end relative to first body 340. Second body 360 may be structurally similar or identical to first body 340, and thus may include the same or similar features therein. For example, second body 360 may include an arcuate radially inward surface 342 shaped to engage the radial exterior of platform 302. Second body 360 may also include a radially outer surface 364 with multiple dovetail slots 366.

Each dovetail slot 366 of second body 360 can be shaped to engage dovetail protrusion 122 of a respective turbine blade 120. Thus, first and second bodies 340, 360 of fixture 300 can engage multiple turbine blades 120 therein through dovetail slots 346, 366. Axial members 354 of fixture 300 can provide a mechanical connection and physical alignment between first and second bodies 340, 360, e.g., such that each dovetail slot 146 is substantially axially aligned with a respective dovetail slot 366 of body 360 and a respective dovetail slot 132 of rotor wheel 130. Second body 360 may also include first and second alignment apertures 350, 352 similar to those of first body 340 and/or arranged in the same manner. For example, first and second alignment apertures 350, 352 may be positioned adjacent to opposing circumferential sidewalls of one or more dovetail slots 366 of second body 360.

First and second alignment apertures 350, 352 of fixture 300 may each be shaped to house an alignment pin 380 therein. Each alignment pin 380 may optionally be coupled to other portions of fixture 300, e.g., through one or more tethers (e.g., tether 182 (FIGS. 2-3)). Alignment pins 380 can be shaped shaped to extend linearly through first and/or second alignment apertures 350, 352 of fixture 300. As noted elsewhere herein relative to fixture 100 (FIGS. 2-3), a user may insert alignment pin(s) 380 through alignment apertures 350, 352 to define axial boundaries during transfer of each turbine blade 120. Alignment pins 380 may obstruct turbine blades 120 from entering axially misaligned dovetail slots 132 and/or contacting other portions of rotor wheel 130.

Figure 7:
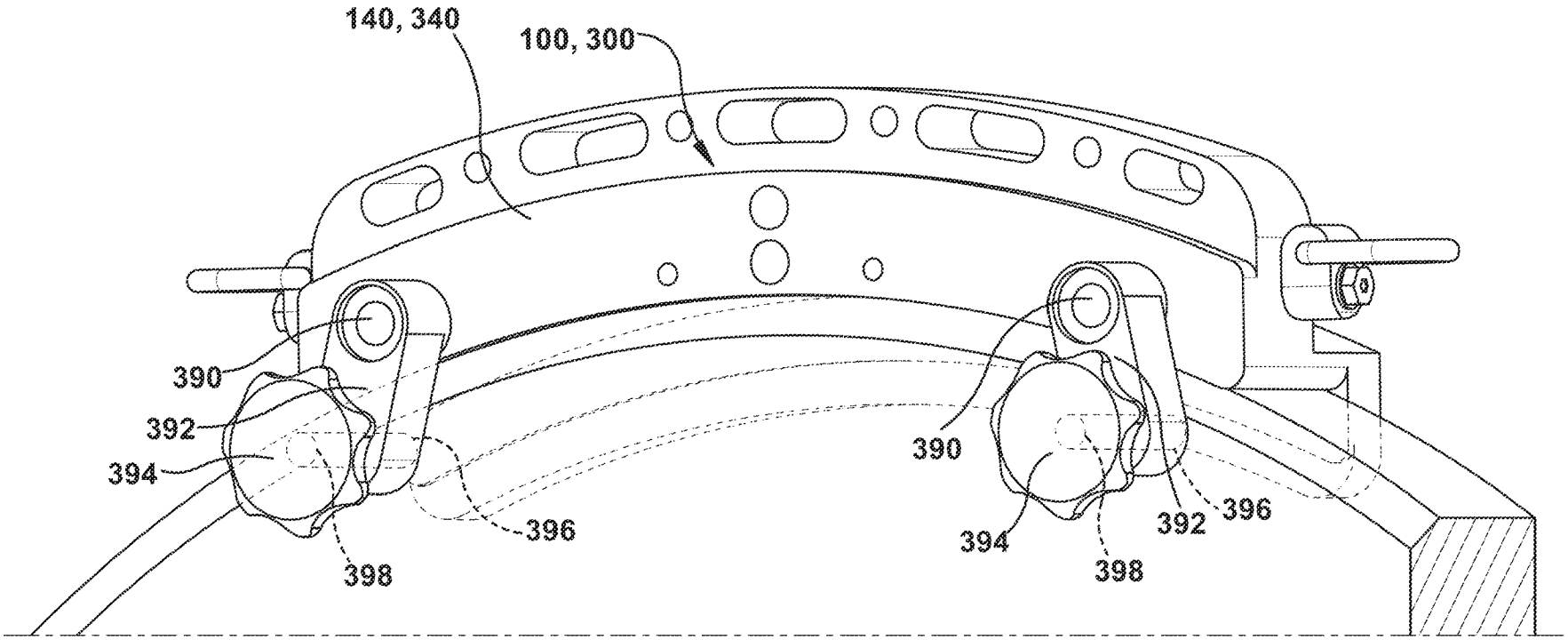
FIG. 7 is perspective view of a fixture axially coupled to a connecting aperture of a rotor wheel according to embodiments of the present disclosure.

Referring to FIG. 7, embodiments of fixture(s) 100, 300 can include additional components for mechanically securing first body 140, 340 to rotor 12. Some features of fixture(s) 100, 300 (e.g., platform 302 (FIGS. 5-6)) are omitted from FIG. 7 for the sake of clarity and to better demonstrate the features shown therein. In addition, although only first body 140, 340 is shown by example in FIG. 7, further embodiments of fixture(s) 100, 300 can alternatively or additionally include the various elements described herein used in conjunction with second body 160, 360, e.g., through modifications apparent to those having ordinary skill in the art. Fixture 100, 300 may include a coupler 390 therein such as an axially-extending bolt, fastener, clamp, etc., configured to mechanically couple fixture 100, 300 to a connecting member 392. Connecting member 392 may include or otherwise be embodied as a radially-extending component such as a non-flexible beam, arm, plate, etc., secured to fixture 100, 300 through coupler 390. Connecting member 392 may include one or more metallic and/or polymerous materials described elsewhere herein, or may have a different material composition. Connecting member 392 may be connected to coupler 390 on one end, and may also be connected to a rotor coupler 394 at another end. Rotor coupler 394 may engage an axial surface 396 of rotor 12, e.g., by being embodied as a threaded or length-adjustable member for mechanically engaging rotor 12. In addition, rotor coupler 394 may be coupled to connecting member 392 by extending through a passage 398 of connecting member 392. However embodied, rotor coupler 394 may extend from connecting member 392 proximal to rotor 12, while coupler 390 may extend from connecting member 392 proximal to fixture 100, 300.

In some embodiments, axial surface 396 of rotor 12 may be adapted for receiving a fastener thereon, e.g., by not including additional elements, mechanical connections, etc., where rotor coupler 394 engages rotor 12. In other embodiments, rotor 12 may be modified such that axial surface 396 is shaped, designed, etc., to accommodate the shape of rotor coupler 394 thereon. However embodied, coupler 390, connecting member 392, and/or rotor coupler 394 can further secure fixture 100, 300 to rotor 12 during operation to prevent sliding movement of fixture 100, 300 during the installation of turbine blades 120 as discussed elsewhere herein. In addition, axial passage 398 of connecting member 392 may also have a size and shape for receiving an axial-cross section of rotor coupler 394 therein. Thus, the surface area of axial surface 396 on rotor 12 may have a similar or identical surface area to that of axial passage 398.

Figure 8:
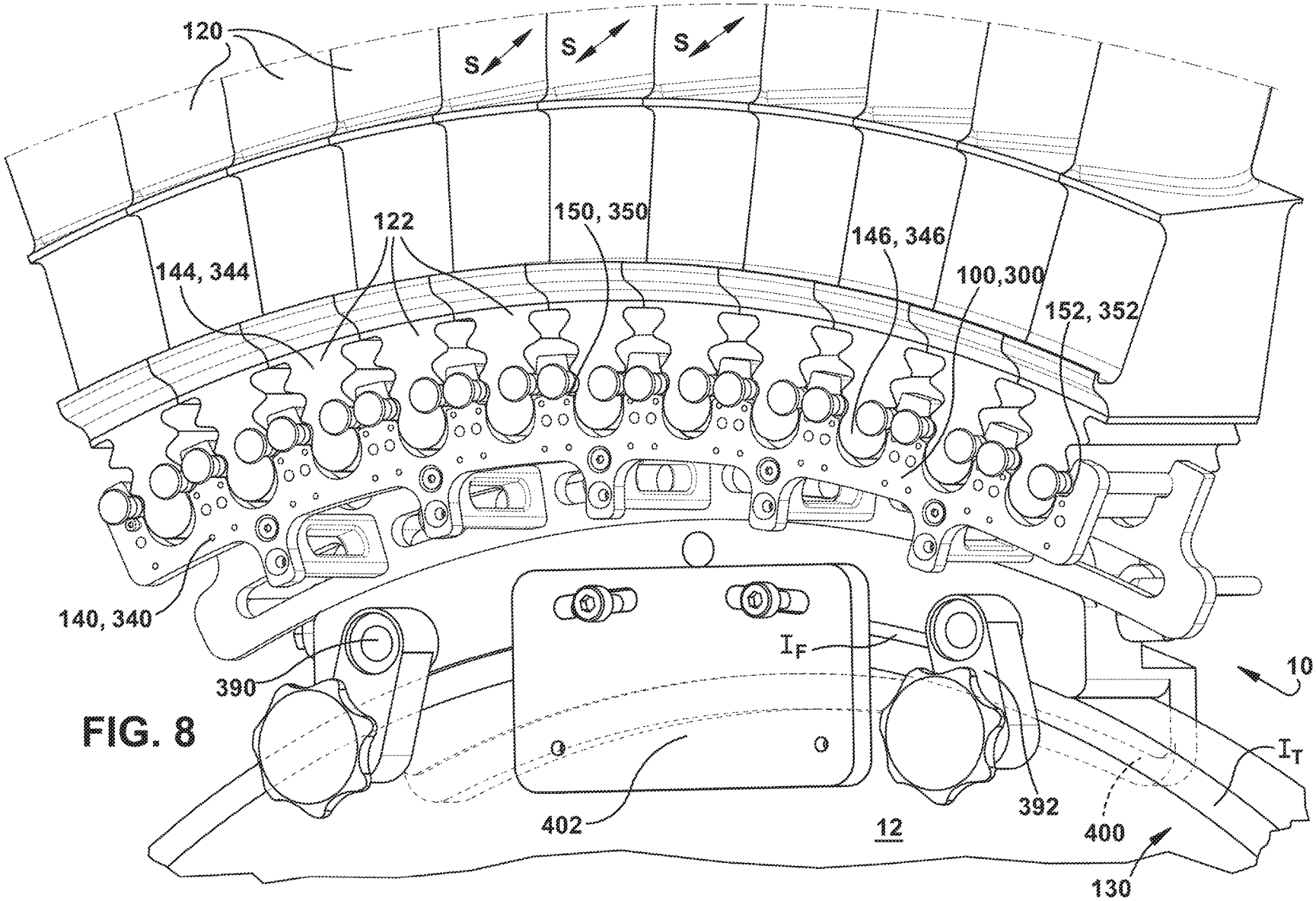
FIG. 8 is a perspective view of a plurality of turbine blades in a fixture being transferred to a rotor wheel according to embodiments of the present disclosure.

Turning to FIG. 8, embodiments of a method for transferring turbine blades 120 into rotor wheel 130 of turbomachine 10 according to embodiments of the present disclosure are described. Similar to other FIGS. described herein, the various processes described herein may be implemented through embodiments of fixture 100, 300 and/or equivalent alternatives where applicable. Embodiments of fixture 100, 300 may be effective for installing a plurality PB of circumferentially adjacent turbine blades 120, each having respective dovetail protrusions 122, together without removing other turbine blades 120 from rotor 12. Methods of transferring turbine blades 120 through fixture 100, 300 can thereby reduce the time and costs of transferring all turbine blades 120 onto rotor 12 during and/or after a servicing operation (e.g., replacement of one or more turbine blades 120). In an embodiment, a radially inward surface $I_F$ of fixture 100, 300 can be engaged with a radially outward surface $I_T$ of turbomachine 10, e.g., by being positioned on a rotor stub shaft ("shaft") 400, proximal to rotor wheel 130.

Radially outward surface $I_T$ can be positioned on any desired component of turbomachine 10, and in an example embodiment can be a portion of rotor wheel 130. In addition to coupler 390, connecting member 392, and/or other elements described herein for mechanically securing fixture 100, 300 to turbomachine 10 in a selected position, fixture 100 may also be mechanically secured to turbomachine 10 through a securing member 402, e.g., a plate, mount, and/or other mechanical element. As shown, securing member 402 may extend radially and may be mounted on portions of fixture 100, 300, shaft 400, and/or rotor wheel 130 to further prevent movement of fixture 100, 300 relative to turbomachine 10. Securing member 402 may be coupled to an axial end of rotor wheel 130, e.g., by including bolts which extend into corresponding slots (not shown) of rotor wheel 130. Securing member 402 can thereby by adjusted to align with predetermined turbine blades 120. In some embodiments, fixture 100, 300 may be mounted on shaft 400 without securing member 402 being present.

Upon engagement of fixture 100, 300 with turbomachine 10, embodiments of the present disclosure can include loading turbine blades 120 into dovetail slots 146, 346 of fixture 100, 300. As noted elsewhere herein, fixture 100, 300 can include multiple dovetail slots 146, 346 for loading each turbine blade 120 of plurality $P_B$. A user may load turbine blades 120 into fixture 100, 300 manually and/or with the aid of external devices for mechanically loading turbine blades 120 into dovetail slots 146, 346. As discussed elsewhere herein relative to FIG. 4, turbine blades 120 may partially or fully engage dovetail slots 146, 346 when loaded therein. Initially, upon being loaded within fixture 100, 300, each turbine blade 120 may be axially displaced from dovetail slot(s) 132 (FIGS. 2, 5-6) of rotor wheel 130. Embodiments of the present disclosure can further include mechanically securing fixture 100, 300 to rotor 12 before or after loading turbine blades 120 into fixture 100, 300. For example, components such as, e.g., coupler 172, coupler 390, shaft 400, securing member 402, etc., may be connected to fixture 100, 300 and turbomachine 10 before turbine blades 120 are installed to maintain fixture 100, 300 in a predetermined location. Where the above-noted components mechanically secure fixture 100, 300 to turbomachine 10 before turbine blades 120 are loaded into dovetail slots 146, 346, fixture 100, 300 may remain in a predetermined position as turbine blades 120 are transferred to rotor wheel 130.

Methods according to the present disclosure can further include transferring turbine blades 120 to their intended sites of placement within rotor wheel 130. As noted elsewhere herein, a user of fixture 100, 300 may insert alignment pin(s) 180, 380 through alignment apertures 150, 152, 350, 352 to define an axial path (e.g., direction S) for transfer. Plurality $P_B$ of turbine blades 120, after being loaded into fixture 100, 300 may then be axially transferred (e.g., along direction S) from dovetail slots 146, 346 of fixture 100, 300 to a corresponding dovetail slot 132 (FIGS. 2, 5-6) of rotor wheel 130. Each turbine blade 120 may be transferred from fixture 100 to rotor wheel 130 manually by a user and/or with the aid of external tools or other types of equipment for moving turbine blades 120. Embodiments according to the present disclosure can thereby provide methods in which multiple turbine blades 120 are transferred axially from the same fixture 100, 300 into one rotor wheel 130 together, without being installed one-at-a-time or through more time-consuming processes.

Embodiments of the present disclosure can provide several technical and commercial settings, some of which are discussed herein by way of example. Embodiments of the present disclosure can also be employed for processes and/or events requiring at least partial disassembly of a rotating component and/or turbine stage, such as during the inspection of a hot gas path section of particular components (e.g., stage three blades of a steam or gas turbine). The application of a fixture with turbine blade holders furthermore can allow multiple turbine blades to be transferred to a rotor wheel together, without each blade being transferred to a rotor wheel individually. It is also understood that embodiments of the present disclosure can provide advantages and features in other operational and/or servicing contexts not addressed specifically herein.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fixture for transferring a plurality of turbine blades, each having a dovetail, into a rotor wheel of a turbomachine, the rotor wheel including a plurality of circumferentially spaced rotor wheel dovetail slots, the fixture comprising:

a first body having an arcuate radially inward surface shaped to contact a rotor of the turbomachine, and a radially outward surface including a plurality of first body dovetail slots therein shaped to engage the dovetails of the plurality of turbine blades;

a first alignment aperture extending axially through the first body relative to a centerline axis of the turbomachine, and positioned for alignment with a portion of the rotor wheel such that the plurality of first body dovetail slots are substantially axially aligned with the plurality of rotor wheel dovetail slots for at least partial transfer of the turbine blade thereto from the fixture, wherein the dovetails of the plurality of turbine blades are slidably removable from the plurality of first body dovetail slots for guided insertion into the plurality of rotor wheel dovetail slots; and a second body axially displaced from the first body, the second body coupled to an axial member such that the axial member extends between the first and second bodies, the second body having an arcuate radially inward surface shaped to contact the rotor of the turbomachine, and an arcuate radially outward surface including a plurality of second body dovetail slots therein shaped to engage the dovetails of the plurality of turbine blades.

2. The fixture of claim 1, wherein a sidewall of the first body axially engages a sidewall of the rotor wheel.

3. The fixture of claim 1, further comprising: the axial member coupled to a sidewall of the first body;

the second body coupled to the axial member such that the axial member extends between the first and second bodies; and a second alignment aperture extending axially through the second body, and substantially axially aligned with the first alignment aperture and the portion of the rotor wheel.

4. The fixture of claim 3, further comprising a coupler coupled to the second body for securing the fixture to the rotor wheel.

5. The fixture of claim 4, wherein the coupler couples the second body to a connecting aperture of the turbomachine.

6. The fixture of claim 1, wherein the first body is composed at least partially of a plastic and a metal.

7. The fixture of claim 1, wherein one of the plurality of first body dovetail slots includes one of a window space or a pocket shaped for displacement from one of the plurality of turbine blades.

8. The fixture of claim 1, further comprising a second alignment aperture extending axially through the first body and positioned adjacent to a circumferential sidewall of one of the plurality of first body dovetail slots, wherein the first alignment aperture is positioned adjacent to an opposing circumferential sidewall of the one of the plurality of first body dovetail slots.

9. The fixture of claim 1, further comprising an alignment pin coupled to the first body through a tether, wherein the alignment pin is shaped to extend through the first alignment aperture.

10. A fixture for transferring a plurality of turbine blades, each having a dovetail, into a rotor wheel of a turbomachine, the rotor wheel including a plurality of circumferentially spaced rotor wheel dovetail slots, the fixture comprising:

a first body having an arcuate radially inward surface shaped to contact a rotor of the turbomachine, and a radially outward surface including a plurality of first body dovetail slots therein shaped to engage the dovetails of the plurality of turbine blades;

a first alignment aperture extending axially through the first body relative to a centerline axis of the turbomachine, and positioned for alignment with a portion of the rotor wheel such that the plurality of first body dovetail slots are substantially axially aligned with the plurality of rotor wheel dovetail slots for at least partial transfer of the turbine blade thereto from the fixture, wherein the dovetails of the plurality of turbine blades are slidably removable from the plurality of first body dovetail slots for guided insertion into the plurality of rotor wheel dovetail slots;

an axial member coupled to a sidewall of the first body;

a second body axially displaced from the first body, the second body coupled to the axial member such that the axial member extends between the first and second bodies, the second body having an arcuate radially inward surface shaped to contact the rotor of the turbomachine, and an arcuate radially outward surface including a plurality of second body dovetail slots therein shaped to engage the dovetails of the plurality of turbine blades; and a second alignment aperture extending axially through the second body, and substantially axially aligned with the first alignment aperture and the portion of the rotor wheel.

11. The fixture of claim 10, wherein a sidewall of the first body axially engages a sidewall of the rotor wheel.

12. The fixture of claim 10, further comprising a coupler coupled to the second body for securing the fixture to the rotor wheel.

13. The fixture of claim 12, wherein the coupler couples the second body to a connecting aperture of the turbomachine.

14. The fixture of claim 10, wherein the first body is composed at least partially of a plastic and a metal.

15. The fixture of claim 10, wherein one of the plurality of first body dovetail slots includes one of a window space or a pocket shaped for displacement from one of the plurality of turbine blades.

16. The fixture of claim 10, further comprising the second alignment aperture extending axially through the first body and positioned adjacent to a circumferential sidewall of one of the plurality of first body dovetail slots, wherein the first alignment aperture is positioned adjacent to an opposing circumferential sidewall of the one of the plurality of first body dovetail slots.

17. The fixture of claim 10, further comprising an alignment pin coupled to the first body through a tether, wherein the alignment pin is shaped to extend through the first alignment aperture.

* * * * *